US006737656B2

(12) United States Patent
Sauvage et al.

(10) Patent No.: US 6,737,656 B2
(45) Date of Patent: May 18, 2004

(54) SCREEN FOR CONVERTING X-RAYS INTO LIGHT PHOTONS

(75) Inventors: Francis Sauvage, Moirans (FR); Régis Guillemaud, La Tronche (FR); Michel Antonakios, Fontaine (FR); Gérard Sanchez, Grenoble (FR)

(73) Assignee: Commissariat a l'Energie Atomique, Paris (FR)

( * ) Notice: Subject to any disclaimer, the term of this patent is extended or adjusted under 35 U.S.C. 154(b) by 71 days.

(21) Appl. No.: 10/084,452

(22) Filed: Feb. 28, 2002

(65) Prior Publication Data

US 2002/0130272 A1 Sep. 19, 2002

(30) Foreign Application Priority Data

Mar. 13, 2001 (FR) ..... 01 03390

(51) Int. Cl.[7] ..... G21K 4/00
(52) U.S. Cl. ..... 250/483.1
(58) Field of Search ..... 250/483.1

(56) References Cited

U.S. PATENT DOCUMENTS 4,710,637 A 12/1987 Luckey et al.
4,789,785 A 12/1988 Yamazaki et al.
5,274,864 A * 1/1994 Morgan ..... 5/627
5,405,107 A * 4/1995 Bruno ..... 244/117 R
5,519,229 A * 5/1996 Verbeke et al. ..... 250/484.4
5,751,001 A * 5/1998 Verbeke ..... 250/484.4
5,935,475 A 8/1999 Scoles et al.

FOREIGN PATENT DOCUMENTS

DE 198 41 772 3/2000
EP 0 327 134 A2 8/1989
EP 0 919 859 A2 6/1999

OTHER PUBLICATIONS

Patent Abstracts of Japan, JP 63–313100, Dec. 21, 1988.

* cited by examiner

*Primary Examiner*—Constantine Hannaher
(74) *Attorney, Agent, or Firm*—Oblon, Spivak, McClelland, Maier & Neustadt, P.C.

(57) ABSTRACT

A screen panel for converting X-rays into light photons includes a rigid foam plate (2), a first layer (1) of composite material located on one face of the rigid foam plate (2) and a second layer (3) of composite material located on the other face of the rigid foam plate, parallel to the first face. The screen panel applies, for example, to medical radiology and to non-destructive testing of nuclear waste storage packages.

7 Claims, 1 Drawing Sheet

SCREEN FOR CONVERTING X-RAYS INTO LIGHT PHOTONS

TECHNICAL FIELD AND STATE OF THE PRIOR ART

The invention concerns a screen for converting X-rays into light photons.

The invention also concerns a screen panel for converting X-rays into light photons as well as a radiological device comprising such a conversion screen.

The invention applies to fields that use the conversion of X-rays into light photons such as, for example, the field of medical radiology or the filed of non-destructive testing of nuclear waste storage packages.

In the field of medical radiology, a screen for converting X-rays into light photons is associated with the means for emitting X-rays and the means for acquiring and displaying an image in order to make a radiology device.

According to the known art, a radiology device comprises an X-ray generator associated with an X-ray tube, a support (on which a patient or an object is placed), and a radiographic film. A flow of X-rays is emitted by the X-ray tube. This flow of X-rays is attenuated by the patient or the object. The residual flow that is transmitted through the patient or the object is measured by the radiographic film. There is then an interaction between the non-attenuated X photons and the radiographic film.

In the field of medical imaging, large size conversion screens are often required. For example, screens of 43 cm×43 cm are necessary to achieve "wide field" acquisitions such as pulmonary radiographs, and screens of 80 cm×60 cm are necessary for non-destructive testing.

Apart from their large size, conversion screens used in medical imaging must be as precise and have as high a performance as possible, in other words they must provide the largest number of light photons possible, for each X photon interacting with the screen.

According to the known art, such screens comprise a rigid panel (a metal sheet or a glass sheet) that is covered, on one face, by a layer of scintillating material such as gadolinium oxysulphide or cesium iodide (CsI), which ensures that the X-rays are converted into visible light. The metal sheet or glass sheet ensures that the conversion screen is rigid. Such a conversion screen in then placed in the radiological device in such a way as to ensure that the light from the X radiant image can be emitted towards the digital sensor.

This type of technology does not enable large size screens with high performance to be made. In fact, for large size screens, for example screens with dimensions greater than or equal to 40 cm×40 cm, flexion occurs in the centre of the screen.

In the event where, for example, the optics used make it necessary to have a fixed focal distance and a field depth whose precision must reach more or less 100 microns at the screen level, the slightest mechanical deformation then causes the captured image to be blurred.

The deformations in the screen may be partially corrected by increasing the thickness of the panel but then the panel absorbs part of the X-rays and the image resolution is considerably deteriorated.

In the event where a glass panel is used, another disadvantage is the presence of multiple internal light reflections within the panel, and these reflections also disrupt the proper operation of the device.

The invention does not have these disadvantages.

DESCRIPTION OF THE INVENTION

In fact, the invention concerns a screen panel for converting X-rays into light photons. The panel comprises a rigid foam plate, a first layer of composite material located on one face of the rigid foam plate and a second layer of composite material located on the other face of the rigid foam plate, parallel to the first face.

The assembly comprising the first layer of composite material, the rigid foam plate and the second layer of composite material provides a solution to the problem of making large size screens. In fact, this assembly enables a very rigid panel, in terms of deformation, to be made and which only slightly attenuates X-rays. The foam itself is rigid and does not contribute to the reduction in tension or in plating the screen. The foam plate acts as a mechanical support between the layers of composite material that surround it and thus ensures the whole panel assembly has very good rigidity. The foam has the advantage of being only slightly attenuating to X-rays and having a homogeneous structure vis á vis the X-rays.

The invention also concerns a screen for converting X-rays into light photons comprising a panel and an active layer for the conversion of the X-rays into light photons deposited on one face of the panel. The panel is a panel according to the invention.

The invention also concerns a radiological device comprising a screen for converting X-rays into light photons, whereby the conversion screen is a screen according to the invention.

According to the invention, the deformations in the screen are advantageously compatible with the precision of the field depth of the optical devices used.

BRIEF DESCRIPTION OF THE FIGURES

Other characteristics and advantages of the invention will become clearer on reading the description of a preferred embodiment of the invention that follows and by referring to the figures in the Appendix, in which.

DETAILED DESCRIPTION OF A PREFERRED EMBODIMENT OF THE INVENTION

Figure 1:
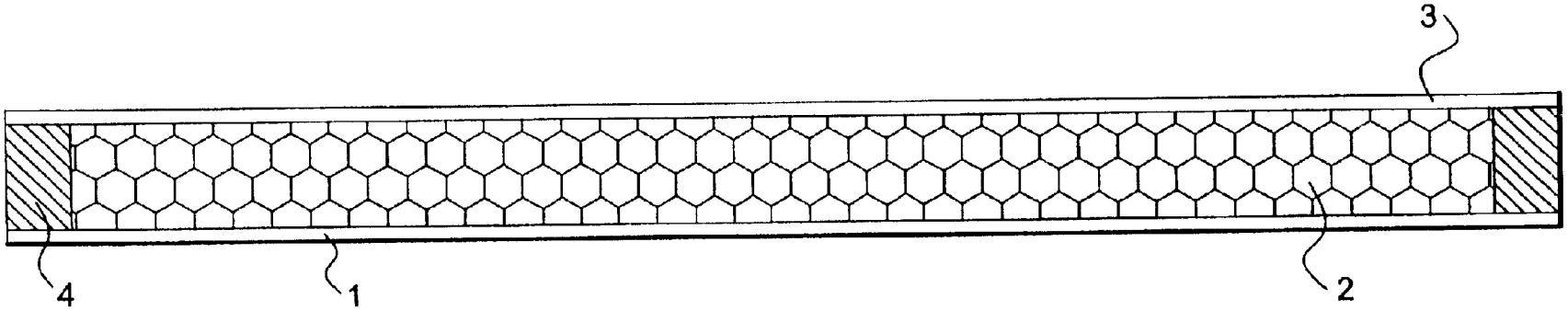
FIG. 1 shows a cross section of a screen panel for converting X-rays into light photons according to the invention.

FIG. 1 shows a cross section of a screen panel for converting X-rays into light photons according to the invention.

The conversion screen panel comprises a first layer of composite material 1, a rigid foam plate that is transparent to X-rays 2, and a second layer of composite material 3. The circumference of the panel is reinforced with a framework 4. The rigid foam plate 2 and the layers of composite material 1 and 3 are assembled by gluing.

The rigid foam used is a high density rigid foam such as, for example, the structural polymethacrylic foam marketed, for example, under the trade name "ROHACEL Foam" and manufactured by the ROHM Company. The layers of composite material 1 and 3 are made out of, for example, a matrix of glass or carbon fibres set in resin. For a screen with dimensions, for example, equal to 45 cm×45 cm, the thickness of the foam plate may be equal to 7 mm and the thickness of the layers of carbon or glass fibres 1 and 3 may be equal to 0.5 mm. In a more general manner, the thickness of the foam plate may be more or less 2% of the length of the screen. The framework 4, preferably made out of the same material as layers 1 and 3, is particularly useful for strengthening the structure of large size screens.

Alternatively, the foam plate may be replaced by a honeycomb plate made out of paper or plastic material, selected so that it only very slightly attenuates the X-rays. This type of honeycomb plate makes it possible to obtain the same mechanical characteristics as a rigid foam plate. The rigid foam plate is however preferred, since it attenuates X-rays less and is also more homogeneous to X-rays.

Figure 2:
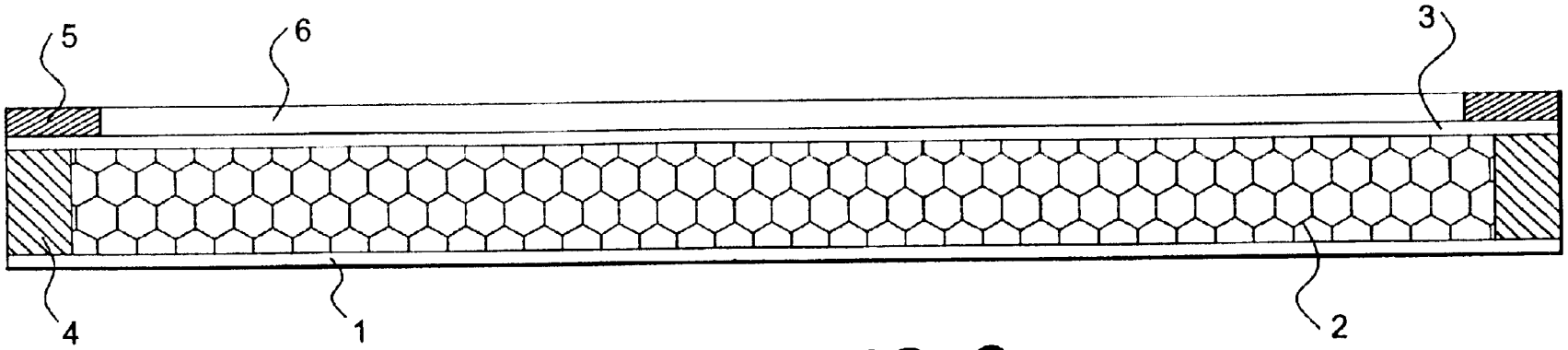
FIG. 2 shows a screen for converting X-rays into light photons according to the invention.

FIG. 2 shows a screen for converting X-rays into light photons according to the invention.

The screen comprises, apart from the panel represented in FIG. 1, a frame 5 deposited on the active face that ensures the conversion. The frame 5 is deposited around the circumference of the active face. The thickness of the frame 5 is more or less equal to the thickness of the active conversion layer 6.

The presence of the frame 5 advantageously makes it possible to directly deposit the conversion layer on the panel.

The technique for depositing the conversion layer also allows a simple manufacture of a high energy screen by the insertion of a sheet of tungsten between the panel and the conversion layer.

Fastening elements (handles, fastening pick-ups) and electrical contacts (not shown in the figure) may be inserted into the frame 5.

A conversion screen according to the invention is advantageously rigid, light and can be used in a vertical position, a horizontal position or in positions between the two. Such a screen can advantageously attain large dimensions. In addition, the thickness of the active layer 6 can easily be controlled when the layer is deposited. Adding intermediate layers between the panel and the active conversion layer, depending on the intended applications, is also easy.

What is claimed is:

1. Screen for converting X-rays into light photons, comprising:

a panel and an active layer for the conversion of X-rays into light photons located on one face of the panel, wherein the panel comprises a rigid foam plate that is transparent to X-rays, a first layer of composite material located on a first face of the rigid foam plate and a second layer of composite material located on a second face of the rigid foam plate, parallel to said first face.

2. Screen according to claim 1, further comprising a framework located on the circumference of the rigid foam plate.

3. Screen according to claim 2, wherein said framework comprises a matrix or glass or carbon fibres set in resin.

4. Screen according to claim 1, wherein the rigid foam is a high density foam and the composite material comprises a matrix of glass or carbon fibres set in resin.

5. Screen according to claim 1, further comprising:

a frame located around the face of the panel on which the active layer is located, so that the active layer is located within the interior of the frame.

6. Screen according to claim 5, further comprising a layer of tungsten located between the panel and the active layer.

7. Radiological device comprising a screen for converting X-rays into light photons, including a conversion screen according to any of claims 1–6.

* * * * *